United States Patent [19]

Orlowski

[11] Patent Number: 4,645,644

[45] Date of Patent: Feb. 24, 1987

[54] METAL ALLOY

[76] Inventor: Gerald J. Orlowski, 6702 E. Turquoise Ave., Scottsdale, Ariz. 85253

[21] Appl. No.: 812,174

[22] Filed: Dec. 23, 1985

Related U.S. Application Data

[63] Continuation-in-part of Ser. No. 734,578, May 15, 1985, abandoned.

[51] Int. Cl.[4] ..... C22E 30/00

[52] U.S. Cl. ..... 420/587; 420/589

[58] Field of Search ..... 420/580, 587, 588, 480, 420/532, 535

[56] References Cited

U.S. PATENT DOCUMENTS 3,284,193 11/1966 Anderson et al. ..... 420/532

OTHER PUBLICATIONS

Baker, H. (ed.) Metals Handbook, vol. 2, Properties and Selection: Non Ferrous Alloys and Rare Metals 1979, p. 320.

*Primary Examiner*—Christopher W. Brody

*Attorney, Agent, or Firm*—Allegretti, Newitt, Witcoff & McAndrews, Ltd.

[57] ABSTRACT

A new alloy containing aluminum, chromium, copper, magnesium, manganese, zinc, titanium dioxide, and cast red brass is disclosed.

2 Claims, No Drawings

METAL ALLOY

BACKGROUND OF THE INVENTION

This application is a continuation-in-part of copending patent application Ser. No. 734,578, filed May 15, 1985 now abandoned.

FIELD OF THE INVENTION

The present invention relates to metal alloys.

BACKGROUND OF THE INVENTION

Though various metal alloys are known in the art, there is a need for a metal alloy that is strong and yet is light in weight. There is also a need for a metal alloy that is nonmagnetic and that can sustain high heat without the occurence of disruptive seaming. Additionally, there is a need for a metal alloy capable of coating other metals and thereby imparting added strength and resistance to disruptive seaming.

SUMMARY OF THE INVENTION

It is an object of the present invention to provide a new metal alloy that is extremely strong and yet light in weight.

It is a further object of the present invention to provide a new metal alloy that is nonmagnetic and is resistant to disruptive seaming under high temperature conditions.

It is an additional object of the present invention to provide a new metal alloy that adds strength and resistance to disruptive seaming to other metals that are coated with it.

It is a specific object of the present invention to provide a metal alloy consisting essentially of 27–32% aluminum, 4–9% chromium, 12–17% copper, 8–13% magnesium, 6–11% manganese, 10–14% zinc, 3.9–4.1% titanium dioxide, and 11–16% cast red brass by weight percent of the total weight of the resulting alloy. The cast red brass used consists essentially of 78–97% copper, 1–7% tin, 1–7% lead, and 1–7% zinc by weight percent of the total weight of the resulting cast red brass. Other elements such as iron, antimony, nickel, phosphorus and sulfur may be present in the cast red brass in amounts of less than 1% by weight.

Further objects and embodiments of the present invention will be set forth in the following description of the preferred embodiments and claims.

DESCRIPTION OF THE PREFERRED EMBODIMENTS

EXAMPLE 1

A bar of the inventive metal alloy measuring 13" by 39" by ½" is prepared in the following manner. Preferably, a primary melting furnace and a secondary holding furnace are initially purified by heating the melting pots in these furnaces to approximately 2300° C. The temperature of the primary melting furnace is then adjusted to the approximate melting point of the first metal to be melted. After the first metal is melted in the primary furnace, this molten metal is transferred to the secondary holding furnace. The temperature of the melting pot in the first furnace is then adjusted to the approximate melting point of the second metal to be melted. After the second metal is melted in the primary furnace, the second molten metal is transferred to the secondary furnace where it is mixed with the first molten metal. With the addition of each new metal, the temperature of the melting pot in the secondary furnace is adjusted such that the mixture of metals contained therein remains molten. The molten metals in the melting pot of the secondary furnace should also be stirred continuously.

The above process of melting additional metals in the primary furnace and then transferring the molten metals to the secondary holding furnace continues until all of the metal constituents have been melted and added to the melting pot of the secondary furnace. At this point, the titanium dioxide is then melted in the primary furnace and added to the melting pot in the secondary furnace. After the titanium dioxide is added to the second melting pot, the resulting molten alloy mixture is continuously stirred for approximately one minute. The temperature in the melting pot of the secondary furnace is then raised to between approximately 1850°–2000° C. in order to eliminate any impurities, which will form a slag on the top of the melting pot. These impurities should be removed immediately prior to pouring the molten alloy. The resulting melted mixture is then poured into an appropriate mold, such as a sand mold, and is allowed to slowly cool, preferably via air cooling, until the alloy has completely solidified.

To prepare the above metal bar, the following components are first melted in the primary furnace and added to the melting pot in the secondary furnace in the following order.

TABLE 1

| Component | Weight (lbs.) | Weight % | Melting Point (°C.) |
|---|---|---|---|
| Magnesium | 3.85 | 10.8 | 651 |
| Zinc | 4.28 | 12.0 | 419.4 |
| Aluminum | 10.59 | 29.7 | 660.2 |
| Manganese | 3.17 | 8.9 | 1244 |
| Copper | 5.24 | 14.7 | 1083 |
| Cast Red Brass | 4.85 | 13.6 | 1800 |
| Chromium | 2.25 | 6.3 | 1857–1877 |
| Titanium Dioxide | 1.43 | 4.0 | 1660–1670 |

The cast red brass is characterized by the following composition.

TABLE 2

| Component | Weight % |
|---|---|
| Copper | 84.15 |
| Tin | 4.40 |
| Lead | 5.42 |
| Zinc | 5.13 |
| Iron | 0.17 |
| Antimony | 0.12 |
| Nickel | 0.58 |
| Phosphorus | 0.007 |
| Sulfur | 0.019 |

The weight of the resulting bar is approximately 35 pounds. Up to one gram of Red Dye Number 40 may additionally be added to the molten alloy mixture. The percentages in Table 1 above encompass any losses of metal due to vaporization, though they are based on the assumed weight percentages of pure metal. In practice, impure sources of the metal may be used having purity level ranges as low as 68%. The weight percentages noted above in Table 1 for the metal components may be varied by approximately plus or minus 2%. The weight percentage for titanium dioxide may be varied by only plus or minus 1/10th of 1%. The resulting metal alloy is identified by the trade name "TiAlCo-B".

The inventive metal alloy may be used in its solid state for the purposes and by the methods generally known in the art of metal alloys. In its molten state, the inventive metal alloy may be used to coat other metals. For this purpose, the inventive metal alloy should have appropriate flow properties, which are achieved by heating the alloy to approximately 2000° C. and then allowing the molten alloy to cool to approximately 1850° C. before coating. The coating procedure can be facilitated through the use of an applicator, for example, an instrument similar in construction to a conventional paint roller, that can withstand the high temperatures involved. After coating is completed, the coated metal should be quickly chilled in ice water and then baked in an oven at an appropriate temperature for an appropriate period of time, as is well known in the metal coating art.

It is to be understood that the above description of the preferred embodiments emphasizes only certain embodiments. Other embodiments not specifically disclosed may fall within the spirit and scope of the present invention as set forth in the following claims.

I hereby claim as my invention:

1. A metal alloy consisting essentially of 27–32% aluminum, 4–9% chromium, 12–17% copper, 8–13% magnesium, 6–11% manganese, 10–14% zinc, 3.9–4.1% titanium dioxide and 11–16% cast red brass based on the total weight of said alloy, said cast red brass consisting essentially of 78–97% copper, 1–7% tin, 1–7% lead and 1–7% zinc based on the total weight of said cast red brass.

2. A metal alloy consisting essentially of 29.7% aluminum, 6.3% chromium, 14.7% copper, 10.8% magnesium, 8.9% manganese, 12.0% zinc, 4.0% titanium dioxide, and 13.6% cast red brass based on the total weight of said alloy, said cast red brass consisting essentially of 84.15% copper, 4.4% tin, 5.42% lead, 5.13% zinc, 0.17% iron, 0.12% antimony, 0.58% nickel, 0.007% phosphorus and 0.019% sulfur based on the total weight of said cast red brass.

* * * * *